US006021770A

United States Patent [19]

Sodaro

[11] Patent Number: 6,021,770

[45] Date of Patent: Feb. 8, 2000

[54] BOW STABILIZER WITH GAME FINDER

[75] Inventor: John C. Sodaro, Monkton, Vt.

[73] Assignees: Arvid A. Ames, Tomahawk, Wis.; John C. Sodaro, Monkton, Vt.

[21] Appl. No.: 09/121,936

[22] Filed: Jul. 24, 1998

Related U.S. Application Data

[60] Provisional application No. 60/053,927, Jul. 28, 1997, and provisional application No. 60/054,172, Jul. 30, 1997.

[51] Int. Cl.[7] ..... F41B 5/20; F41B 5/14

[52] U.S. Cl. ..... 124/89; 124/86

[58] Field of Search ..... 124/23.1, 86, 89

[56] References Cited

U.S. PATENT DOCUMENTS

| | | | |
|---|---|---|---|
| 3,695,248 | 10/1972 | Izuta | 124/89 X |
| 4,101,704 | 7/1978 | Hiles | 428/218 |
| 4,309,974 | 1/1982 | Carter et al. | 124/23.1 |
| 4,346,205 | 8/1982 | Hiles | 528/53 |
| 4,378,781 | 4/1983 | Shiflett | 124/23.1 |
| 4,570,608 | 2/1986 | Masterfield | 124/89 |
| 4,615,327 | 10/1986 | Saunders | 124/89 |
| 4,660,538 | 4/1987 | Burgard | 124/89 |
| 4,706,788 | 11/1987 | Inman et al. | 188/378 |
| 4,726,348 | 2/1988 | Saunders | 124/23.1 |
| 4,744,347 | 5/1988 | Dodge | 124/86 |
| 4,777,739 | 10/1988 | Hiles | 36/43 |
| 4,955,356 | 9/1990 | Pike et al. | 124/89 |
| 5,016,602 | 5/1991 | Mizek | 124/89 |
| 5,273,022 | 12/1993 | Leven | 124/89 |
| 5,339,793 | 8/1994 | Findley | 124/89 |
| 5,411,009 | 5/1995 | Thompson et al. | 124/89 |
| 5,507,477 | 4/1996 | Manning et al. | 267/140.3 |
| 5,535,731 | 7/1996 | Webster | 124/89 |
| 5,649,527 | 7/1997 | Olsen et al. | 124/89 |
| 5,735,257 | 4/1998 | Walk | 124/89 |
| 5,842,686 | 12/1998 | Hansen et al. | 267/140 |

*Primary Examiner*—John A. Ricci
*Attorney, Agent, or Firm*—Theodore R. Touw

[57] ABSTRACT

A combination archery bow stabilizer and string tracker having a built-in shock- and vibration-damping system comprising a body portion containing a chamber for holding a spool of tracking string and a chamber housing a temperature-insensitive vibration-damping and shock-absorbing viscoelastic polymer element in which a bow-mounting rod is embedded. The viscoelastic polymer element material is preferably a flexible polyurethane of essentially linear structure, containing unsatisfied hydroxyl groups, and having a compression set of less than 15%, an elongation at break of at least 500%, and a recovery after compression which is delayed by at least 0.7 seconds. The system minimizes the vibration due to shock created by the release of the arrow and by the pay out of the tracking string.

21 Claims, 2 Drawing Sheets

BOW STABILIZER WITH GAME FINDER

This application claims priority from U.S. Provisional Patent Applications Ser. No. 60/053,927 "Bow Stabilizer for Archery" filed on Jul. 28, 1997 and Ser. No. 60/054,172 "Bow Stabilizer Game Finder" filed on Jul. 30, 1997.

TECHNICAL FIELD

The present invention relates to the field of archery. More specifically, it relates to an apparatus for stabilizing the bow, especially when the bow is to be used in hunting, and for tracking the flight of arrows.

BACKGROUND ART

Accuracy in archery can be improved by addition of stabilizing devices to bows to improve the balance and to reduce torque, shock, and vibration otherwise occurring when an arrow is shot. For bows used in hunting, small size, minimal weight, and low noise are distinct additional advantages.

Another aspect of archery as it applies to hunting is the tracking and recovery of arrows and game. Generally, a spool of string is attached to the bow and one end of the string attached to the arrow. As the arrow flies, the string spools out. If the arrow misses the intended target, the string may be followed to retrieve the arrow. If the arrow hits the intended target, the string may be followed to retrieve the game. Simplicity of construction and ease of use are advantages in a string tracker used in hunting.

Various bow stabilizer and tracker structures are known in the background art. U.S. Pat. No. 4,570,608 to Masterfield shows an inertial archery bow stabilizer and vibration dampener having a stud rigidly embedded in the archery bow and an energy-dissipating rod fixed to the stud and projecting forwardly of the stud. The rod is received within an encapsulating sealed cylinder having an internal chamber filled with a viscous fluid in which the rod is disposed. At its outer end, the cylinder is provided with an external stud to which the archer may affix a selected stabilizing weight.

U.S. Pat. No. 4,615,327 to Saunders discloses a two-stage resiliently mounted stabilizer in which the first stage has a first housing resiliently mounted to a pedestal by use of a flat resilient washer and a tubular resilient member within the housing. The second stage of resilient mounting of the stabilizer includes a pair of tubular resilient members, one being disposed in the first housing and the second being disposed in a second housing. A second flat washer separates the two housings and a connecting member is used to connect the second and third tubular members and to tighten them together as well as to tighten the flat washer in a resilient fashion, to allow the second housing to move with respect to the first housing. Additional weights can be attached to the second housing.

U.S. Pat. No. 4,955,356 to Pike et al. discloses an archery bow stabilizer and tracker having first and second threadably connectable body members, the second member being utilized with a removable bushing to allow use of a variety of standard archery tracking cords. An additional weight may be afforded through the use of a threaded extension member.

U.S. Pat. No. 5,016,602 to Mizek discloses a bow stabilizer having a hollow body which defines a chamber, an end plug sealably secured to the hollow body, another end plug sealably secured to an opposite end, and at least one counterweight which is adjustable along a longitudinal axis of the hollow body to balance the archery bow. The chamber of the hollow body is partially filled with granular solids.

U.S. Pat. No. 5,273,022 to Leven discloses an apparatus for use with an archery bow stabilizer comprising a resilient elastomeric member, a housing having an open end, means for mounting the elastomeric member in the housing so that an end of the member extends from the housing, means for coupling the apparatus to an archery stabilizer arm at one end, and a stabilizer weight at the opposite end for providing an angularly flexible connection of selected resilience. A weight support arm for an archery bow stabilizer comprises an elongate tubular housing, coupling means for securing the stabilizer to an archery bow, and damping means disposed in the housing in a relaxed position for providing reduction of vibration.

U.S. Pat. No. 5,411,009 to Thompson et al. discloses a compound bow anti-vibration and -noise device having a fluid-filled tube mounted horizontally to the bow body, having a cylinder mounted within the tube, and having a tuning rod or wire mounted within the cylinder.

U.S. Pat. No. 5,535,731 to Webster teaches an archery bow stabilizer that comprises a set of four rods or arms which extend from an attachment block, which block is attachable to a standard stabilizer attachment fitting on an archery bow. The attachment block defines a common intersection for each pair of arms, thereby providing a simple resolution of the forces involved, and provides for each of the four arms to extend into one of the four quadrants defined by the longitudinal and lateral axes of the bow. The outer tip of each of the stabilizing arms or rods is downwardly disposed. The downwardly disposed arms include removably adjustable masses at their tips, which also serve to lower the common center of mass of the bow and stabilizer assembly to a point approximating the hand grip of the bow.

U.S. Pat. No. 5,649,527 to Olsen et al. teaches a combination archery bow stabilizer and string tracker mounting adapter having a telescopic capability to raise or lower the string tracker. The string tracker is mounted to a 360-degree rotatable arm. The adapter and rotatable arm are capable of adjustment for the needs of the individual archer or archery bow to which it is mounted.

U.S. Pat. No. 5,735,257 to Walk shows a multi-chamber stabilizer with an elongate housing having a plurality of separate internal chambers suitable for containing damping material or damping devices, which may be of different types.

DISCLOSURE OF INVENTION

Disclosed herein is a combination bow stabilizer and string tracker device directly mountable to a bow. The device is contained in a single body having a section for holding a spool of tracking string and having a section holding shock absorption and vibration damping material. The stabilizer and string tracker combination is designed to be mounted near the center of the bow and parallel to the general direction of an arrow held in a shooting position. The combination stabilizer combines the functions of stabilizing the bow (especially against torque and vibration) during release of an arrow, and tracking the arrow after release.

The apparatus is formed from a hollow cylinder. A mounting rod is completely embedded in an elastomer, preferably a shock-absorbing and vibration-damping viscoelastic polymer material, contained near one end of the cylinder. The viscoelastic polymer material is preferably a flexible polyurethane of essentially linear structure, containing unsatisfied hydroxyl groups, and having a compression set of less than 15%, an elongation at break of at least 500%, and a recovery after compression which is delayed by at least 0.7 seconds. A suitable viscoelastic polymer material is the material "Sorbothane" available from Sorbothane, Inc. of Kent, Ohio. "Sorbothane" exhibits high stability over a very broad temperature range. Such stability is important for archery during various seasons of the year and in various kinds of weather, as the effect of the stabilizer will remain constant despite environmental temperature variations. The mounting rod is aligned with the longitudinal axis of the body cylinder and has a moderate degree of freedom to move transversely. There is less ability to move longitudinally (toward and away from the bow) as this could adversely effect the balance. There is no direct contact between the mounting rod on the one hand and body cylinder or cap on the other hand. In particular, there is no metal-to-metal contact. The elastomer material thus maintains isolation between the bow and mounting rod and all other parts of the stabilizer and game tracker.

A chamber at the opposite end of the body from the mounting holds a spool of tracking string. A line-retaining cap is threaded into the body. This cap has a double tapered orifice that is smooth with no sharp edges, to allow easy pay out of the tracking line. When the bow is shot, the shock and vibration, including any effect of the line paying out, are absorbed by the "Sorbothane," thus minimizing deflection of the bow at the critical moment of firing.

The weight and moment of inertia of the stabilizer may be changed by the use of materials of various densities for the body and the line-retaining cap so the stabilizer may remain small and compact, be useful for various combinations of bow, arrow, and archer ability, yet still hold a similarly suitable amount of tracking line.

Therefore it is an object of the present invention to provide an extremely quiet stabilizer taking advantage of the special properties of a viscoelastic polymer. It is a further object of the present invention to provide a combination bow stabilizer and game tracker in a single compact body. It is a further object of the present invention to provide a combination bow stabilizer and game tracker having a shock absorption and vibration damping capability over a wide range of temperatures. It is a still further object of the present invention to provide stabilizer and game tracker combination design capable of different inertial characteristics in the same compact size.

BRIEF DESCRIPTION OF DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

BEST MODE FOR CARRYING OUT THE INVENTION

Figure 1:
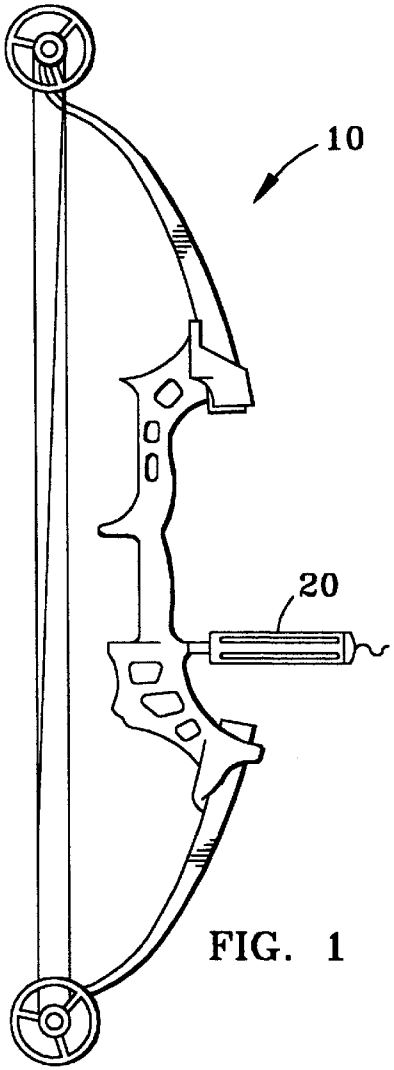
FIG. 1 is a side view of a bow showing a bow stabilizer and game finder made in accordance with the present invention attached.

FIG. 1 shows a bow 10 with bow stabilizer and game tracker 20 attached. Bow stabilizer and game tracker 20 is preferably attached to the handle riser of the bow, below the grip and extending generally forward from the face of the bow as shown in FIG. 1. FIG. 1 is not drawn to scale.

As shown in FIGS. 2, 3, 4, and 5, bow stabilizer and game tracker 20 has a generally cylindrical body 30 having a major longitudinal axis, with a cap end 40 and a mounting end 50 located at opposite ends of the longitudinal axis. Body 30 has an outer surface 60 into which grip grooves 80 have been formed. Grooves 80 allow for gripping bow stabilizer and game tracker 20 when mounting it to bow 10. Line-retaining cap 100, which is detachably mounted to cap end 40 of bow stabilizer and game tracker 20, has a line exit orifice 110 having an outer tapered surface 120 to reduce drag as tracking line 165 exits from line exit orifice 110. Line exit orifice 110 is concentric with the major longitudinal axis of cylindrical body 30. Body 30 and line-retaining cap 100 may be fabricated from steel, copper, brass, aluminum, or plastic, for example. Extending from mounting end 50 of bow stabilizer and game tracker 20 is mounting shaft 200. Shaft 200 is flexibly mounted along the major longitudinal axis of body 30 such that angular deflection in any direction from the longitudinal axis of cylindrical body 30 is permitted. Mounting shaft 200 has hex extension 210 to allow tightening of bow stabilizer and game tracker 20 to bow 10 by first threaded end 220 of mounting shaft 200. Hex extension 210 may be a nut threaded onto mounting shaft 200.

It is important for optimum operation of the stabilizer that there be no direct contact between the mounting shaft 200 on the one hand and body cylinder 30 or cap 40 on the other hand. In particular, there should be no metal-to-metal contact. An elastomer material, described in detail below, maintains vibration isolation between the combination of bow 10 and attached mounting shaft 200 from all other parts of the stabilizer and game tracker.

Figure 2:
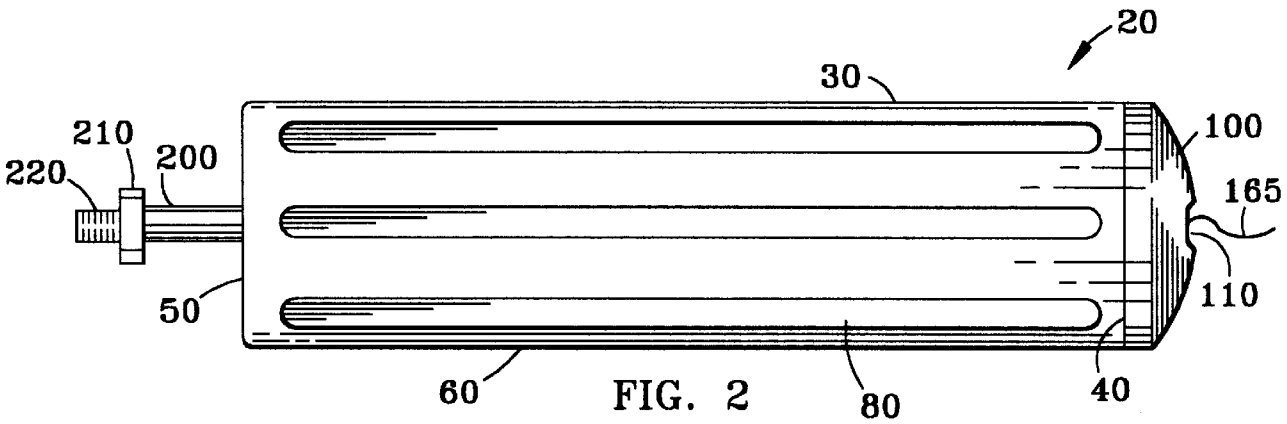
FIG. 2 is a side view of a bow stabilizer and game finder made in accordance with the present invention.
Figure 4:
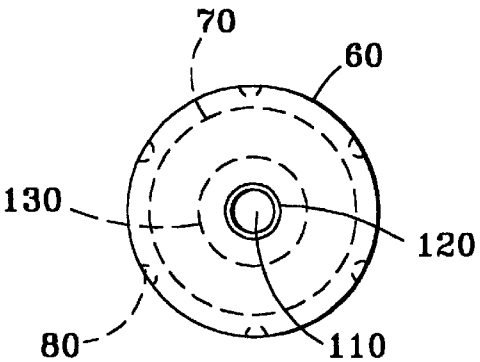
FIG. 4 is an end view from the cap end of the bow stabilizer and game finder of FIG. 2.
Figure 3:
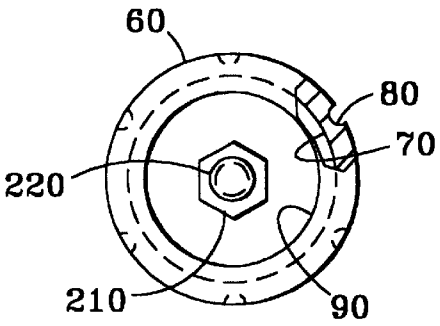
FIG. 3 is an end view from the mounting end of the bow stabilizer and game finder of FIG. 2.

FIG. 3 is an end view of mounting end 50 of bow stabilizer and game tracker 20. Opening 90 in end 50 of body 30 is sized to allow clearance for angular deflection of mounting shaft 200 from the longitudinal axis of cylindrical body 30. Opening 90 is smaller in diameter than the diameter of inner surface 70 of cylindrical body 30. FIG. 4 is an end view of cap end 40 of bow stabilizer and game tracker 20, showing inner tapered surface 130 of line exit orifice 110 in line-retaining cap 100.

Figure 5:
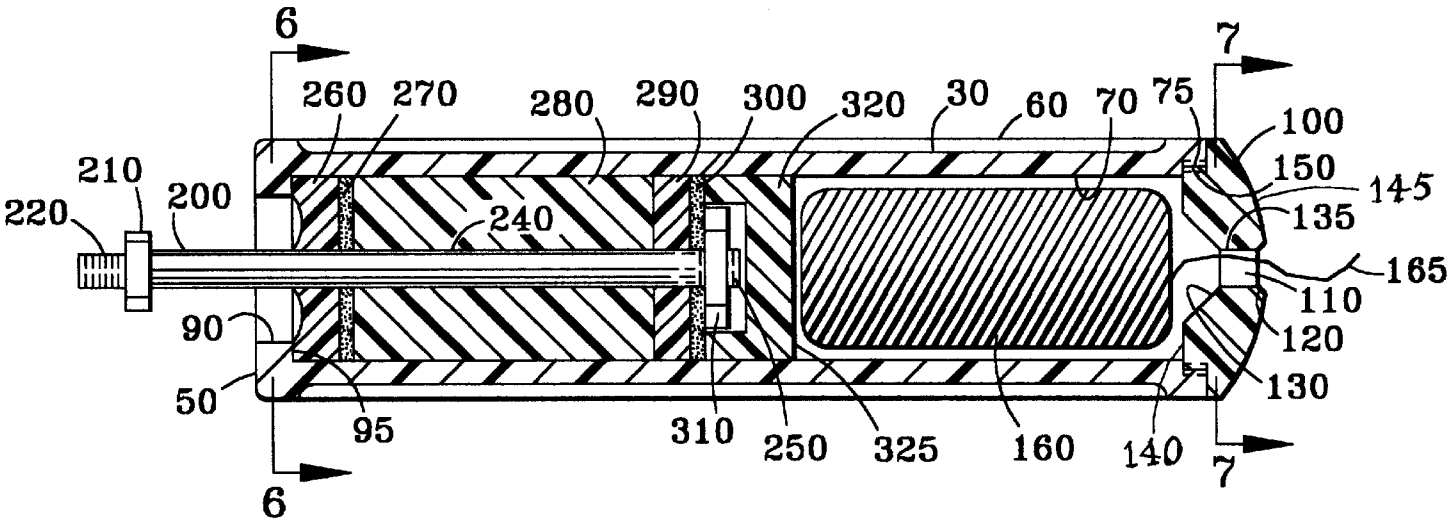
FIG. 5 is a cross-sectional side elevation view of the bow stabilizer and game finder of FIG. 2.
Figure 7:
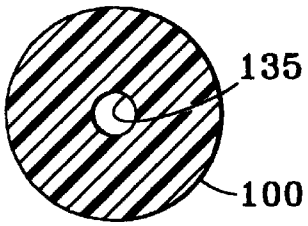
FIG. 7 is a cross-sectional end view through section 7—7 of FIG. 5.
Figure 6:
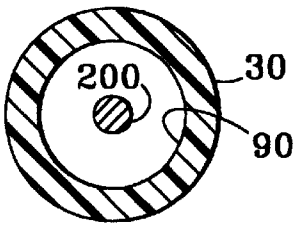
FIG. 6 is a cross-sectional view through section 6—6 of FIG. 5.

As shown in FIGS. 4, 5 and 6, cylindrical body 30 has threads 75 cut into inner wall 70 at cap end 40 for receiving matching threaded ring 150 of line-retaining cap 100. Cylindrical body 30 also has lip 95 at mounting end 50. Lip 95 may be integral to cylindrical body 30 or may be a press fit ring. Middle portion 240 of mounting shaft 200 extends through first mounting elastomer 260, first retaining washer 270, vibration damping elastomer 280, second mounting elastomer 290 and second retaining washer 300. The assembly of first mounting elastomer 260, first retaining washer 270, vibration damping elastomer 280, second mounting elastomer 290 and second retaining washer 300 is compressed against lip 95 by lock-nut 310 engaging second threaded end 250 of mounting shaft 200. First and second retaining washers 270 and 300 are formed of any elastomer, such as rubber. First and second mounting elastomer 260 and 290 are formed of in-situ cast silicone. Thus mounting shaft 200 is embedded in the annular form of vibration damping elastomer 280. Vibration damping elastomer 280 may be formed of any elastomer, but preferably of a vibration-damping viscoelastic polymer material. The viscoelastic polymer material selected for vibration damping elastomer 280 preferably has a compression set of less than 15%, an elongation at break of at least 500%, and a recovery after compression which is delayed by at least 0.7 seconds. A suitable viscoelastic polymer material is a flexible thermoset polyether based polyurethane of essentially linear structure containing unsatisfied hydroxyl groups. An especially suitable viscoelastic polymer material is the polyurethane "Sorbothane" available from Sorbothane Inc. of Kent, Ohio. The viscoelastic polymer "Sorbothane" is described in U.S. Pat. Nos. 4,101,704, 4,346,205, and 4,777,739 to Hiles, the entire disclosure of each of which is hereby incorporated by reference. The durometer specification of vibration damping elastomer 280 should preferably be about 25 to 80, and most preferably about 50 (Shore 00 scale). The high damping performance of the preferred viscoelastic polymer material reduces the impulse peak of a shock wave over a longer time period than with the use of materials such as butyl or neoprene. Low amplification of vibrations at resonance is also a desirable characteristic of vibration damping elastomer 280 for use in the stabilizer, and this characteristic is also provided by the preferred "Sorbothane" material.

It is important that vibration damping elastomer 280 and all the internal elements of the stabilizer be disposed to avoid any metal-to-metal contact in the structure and in the use of the bow stabilizer. Mounting shaft 200 is embedded in at least a portion of the annular form of vibration damping elastomer 280. Thus vibration damping elastomer 280 should surround that portion of mounting shaft 200 that extends inside cylindrical body 30, and mounting shaft 200 should not extend far enough into cylindrical body 30 to make contact with cap end 40 or any other non-elastomeric element that could transmit undamped vibration between mounting shaft 200 and cylindrical body 30 or cap end 40.

Lock-nut 310 is covered by a nut cover 320, which may be formed of a rigid foam. Line-retaining cap 100 has an outer surface 145, an inner surface 140, a line exit orifice 110, and a threaded ring 150. Line exit orifice 110 of line-retaining cap 100 has an outer tapered surface 120 and inner tapered surface 130 communicating with bore 135. Inner and outer surfaces 120 and 130 and bore 135 are concentric with the longitudinal axis of body 30. Outer tapered surface 120 extends from bore 135 to outer surface 145 with the line exit orifice wider at surface 145 than at bore 135. Inner tapered surface 130 extends from bore 135 to inner surface 140 with the line exit orifice wider at surface 140 than at bore 135.

Line 165 is wound on a spool 160 contained in a cavity 170 formed by inner wall 70 of body 30, inner wall 140 of line-retaining cap 100 and surface 325 of nut cover 320. Line 165 preferably constitutes 14 lb. to 20 lb. test nylon line, with 17 lb. test being typical.

Of course the stabilizer may be used without using the game-tracking feature, and versions may be made without a cavity 170 and line orifice 110 for applications in which the game tracking feature is not needed. Versions without the game-tracking feature may be made shorter, omitting the parts not needed, such as cavity 170 and line orifice 110. Such versions are useful for target archery, for example, or for hunting when a very short stabilizer is desired.

INDUSTRIAL APPLICABILITY

The applications of the invention include both target and hunting archery. The invention provides an apparatus for stabilizing the balance and reducing torque of a bow for more accurate shooting and for finding arrows that miss their intended target as well as leading the hunter to game that has been hit. This provides cost saving in terms of arrows, conserves game, and improves the archer's enjoyment of the sport.

The description of the embodiments of the present invention is given above for the understanding of the present invention. It will be understood that the invention is not limited to the particular embodiments described herein, but is capable of various modifications, rearrangements, and substitutions without departing from the scope of the invention. For example, the distribution of mass along the longitudinal axis of the bow stabilizer and game tracker may be varied to vary the system's natural frequency and to vary its moment of inertia about an axis through or near the mounting point. Therefore it is intended that the following claims cover all such modifications and changes as fall within the true spirit and scope of the invention.

Having described my invention, I claim:

1. An archery bow stabilizer comprising:

a hollow body having a longitudinal axis, a first end and a second end;

means for absorbing shock and damping vibration contained within said hollow body adjacent to said first end of said hollow body; and an attachment element for connecting said shock and vibration damping means to said archery bow, said attachment element including means for attaching said element to said archery bow at a first end and means for attaching said attachment element only to said means for absorbing shock and damping vibration at a second end, wherein said means for absorbing shock and damping vibration comprises an annular viscoelastic elastomer disposed between said hollow body and said attachment element, said annular viscoelastic elastomer surrounding said attachment element, for preventing transmission of undamped vibrations between said hollow body and said attachment element.

2. An archery bow stabilizer as in claim 1 wherein said elastomer comprises a viscoelastic elastomer having a compression set of less than 15%, an elongation at break of at least 500%, and a recovery after compression which is delayed by at least 0.7 seconds.

3. An archery bow stabilizer as in claim 1 wherein said elastomer comprises a flexible viscoelastic polyurethane of essentially linear structure containing unsatisfied hydroxyl groups.

4. A combination archery bow stabilizer and game tracking device comprising:

a hollow body having a longitudinal axis, a first end and a second opposite end;

means for absorbing shock and damping vibration contained within said holow body in said first end of said hollow body;

an attchment element for connecting said shock and vibration damping means to said archery bow, said attachment element including means for attaching said element to said archery bow at a first end and means for attaching said attachment element only to said means for absorbing shock and damping vibration at a second end, said means for absorbing shock and damping vibration comprises an annular viscoelastic elastomer disposed between said hollow body and said attachment element, said annular viscoelastic elastomer surrounding said attachment element;

a chamber in said second end of said hollow body for storing a spool of tracking line; and means for retaining said spool of tracking line while allowing said tracking to pay out.

5. A combination archery bow stabilizer and game tracking device as in claim 4 wherein said means for absorbing shock and damping vibration comprises a viscoelastic elastomer.

6. A combination archery bow stabilizer and game tracking device as in claim 5, wherein said viscoelastic elastomer has a compression set of less than 15%, an elongation at break of at least 500%, and a recovery after compression which is delayed by at least 0.7 seconds.

7. A combination archery bow stabilizer and game tracking device as in claim 5, wherein said viscoelastic elastomer comprises a flexible polyurethane of essentially linear structure containing unsatisfied hydroxyl groups.

8. A combination archery bow stabilizer and game tracking device as in claim 4 wherein said attachment element is rotatable through a 360 degree angle about said longitudinal axis of said hollow body.

9. A combination archery bow stabilizer and game tracking device as in claim 4 wherein said attachment element comprises a rod and said means for attaching said attachment element to said means for absorbing shock and damping vibration comprises embedding at least said second end of said rod in said viscoelastic elastomer.

10. A combination archery bow stabilizer and game tracking device as in claim 4 wherein said means for both retaining said spool of tracking line comprises a removable cap having a orifice concentric with said longitudinal axis through which said tracking line is free to pass.

11. A combination archery bow stabilizer and game tracking device as in claim 4 wherein said hollow body is fabricated from a material selected from the group consisting of steel, copper, brass, aluminum, and plastic.

12. A combination archery bow stabilizer and game tracking device comprising:

a hollow cylindrical body having a longitudinal axis, a first end and a second opposite end, an inner surface and an outer surface;

an annular cylinder of viscoelastic elastomer aligned with said longitudinal axis of said hollow body near said first end of said hollow body, said annular cylinder having a central bore;

a rod having a first threaded end for attaching to said archery bow, a middle portion and a second threaded end extending through said central bore of said annular cylinder, said elastomer being contained within said hollow body and held in compression by a retaining ring in said first end of said hollow body and by a lock-nut on said second end of said rod and said first end of rod extending beyond said first end of said body; and a chamber for storing a spool of tracking line, said chamber being defined by said inner wall of said hollow body and a cap mounted in said second end of said hollow body, said cap being detachably mounted to said second end of said hollow body for retaining said spool of tracking line, said cap having a orifice with a central bore concentric with said longitudinal axis of said hollow body for allowing said tracking line to pay out.

13. A combination archery bow stabilizer and game tracking device as in claim 12, wherein said viscoelastic elastomer has a compression set of less than 15%, an elongation at break of at least 500%, and a recovery after compression which is delayed by at least 0.7 seconds.

14. A combination archery bow stabilizer and game tracking device as in claim 12, wherein said viscoelastic elastomer comprises a flexible polyurethane of essentially linear structure containing unsatisfied hydroxyl groups.

15. A combination archery bow stabilizer and game tracking device as in claim 12, further comprising a first rubber washer between said retaining ring and said elastomer and a second rubber washer between said lock washer and said elastomer.

16. A combination archery bow stabilizer and game tracking device as in claim 15, further comprising a first silicone rubber seal between said retaining ring and said first rubber washer and a second silicone rubber seal between said elastomer and said second lock washer.

17. A combination archery bow stabilizer and game tracking device as in claim 12, wherein said cap further comprises a inner surface and an outer surface, and said orifice further comprises a first conical surface extending angularly outward from said bore to said outer surface of said cap and a second conical surface extending angularly outward from said bore to said inner surface of said cap.

18. A combination archery bow stabilizer and game tracking device as in claim 12, wherein said hollow body and said cap are fabricated of a material selected from the group consisting of steel, copper, brass, aluminum, and plastic.

19. An archery bow stabilizer comprising:

a) mounting means for attachment to the bow;

b) a rod affixed to said mounting means and extending forward from said mounting means, said rod having an outer surface;

c) a cylindrical mass disposed around and spaced apart from said rod, said cylindrical mass having an interior surface; and d) an energy-dissipative medium comprising a viscoelastic elastomer disposed between said rod and said cylindrical mass, said energy-dissipative medium extending radially from said rod to said interior surface of said cylindrical mass for damping vibration and for quieting sound resulting from vibration.

20. An archery bow stabilizer as in claim 19, herein said cylindrical mass has front and rear ends, said rear end being open toward said mounting means and said front end being closed.

21. An archery bow stabilizer as in claim 19, wherein said energy-dissipative medium consists of a viscoelastic elastomer comprising a flexible polyurethane of essentially linear structure containing unsatisfied hydroxyl groups, said energy-dissipative medium having a compression set of less than 15%, an elongation at break of at least 500%, and a recovery after compression which is delayed by at least 0.7 seconds.

* * * * *

UNITED STATES PATENT AND TRADEMARK OFFICE

CERTIFICATE OF CORRECTION

PATENT NO. : 6,021,770
DATED : February 29, 2000
INVENTOR(S) : Pawlowski

It is certified that error appears in the above-identified patent and that said Letters Patent is hereby corrected as shown below:

Column 1,
Line 37, after "this", insert -- goal --.

Column 3,
Line 14, after "the," insert -- present --.

Column 5,
Line 47, after "identical", delete "Lo" and replace therewith -- to --.

Column 6,
Line 36, after "of the", delete "LFAD" and replace therewith -- LEAD --.

Column 8,
Line 46, after "time", delete "to" and replace therewith -- tº --.

Signed and Sealed this

Twenty-second Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,021,770
DATED : February 8, 2000
INVENTOR(S) : John C. Sodaro

It is certified that error appears in the above-identified patent and that said Letters Patent is hereby corrected as shown below:

This certificate supersedes Certificate of Correction issued July 22, 2003, the number was erroneoulsly mentioned and should be vacated since no Certificate of Correction was granted.

Signed and Sealed this

Twenty-fifth Day of May, 2004

JON W. DUDAS
*Acting Director of the United States Patent and Trademark Office*